US005560222A

United States Patent [19]

Perron

[11] Patent Number: 5,560,222

[45] Date of Patent: Oct. 1, 1996

[54] COMBINED AIR HEATING AND COOLING DOMESTIC UNIT

[76] Inventor: Joseph Perron, 20, 6ième avenue, Sainte-Foy (Québec), Canada, G3A 1W7

[21] Appl. No.: 373,699

[22] Filed: Jan. 17, 1995

[51] Int. Cl.[6] ..... F25D 17/02

[52] U.S. Cl. ..... 62/435; 62/99; 165/61

[58] Field of Search ..... 62/98, 99, 430, 62/434, 435, 331, 238.1; 165/61–65, 50, 58, 59; 257/46

[56] References Cited

U.S. PATENT DOCUMENTS

| | | | |
|---|---|---|---|
| 2,022,133 | 11/1935 | Morse et al. | 165/61 |
| 2,246,999 | 6/1941 | Morrison | 62/434 |
| 3,105,137 | 9/1963 | Sullivan et al. | 165/61 |
| 3,148,513 | 9/1964 | Ewing | 62/435 |
| 3,156,101 | 11/1964 | McGuffey | 62/430 |
| 3,301,318 | 1/1967 | Haake | 62/435 |
| 3,766,752 | 10/1973 | Laing | 62/435 |
| 4,522,253 | 6/1985 | Levin | 165/18 |

*Primary Examiner*—Henry A. Bennett
*Assistant Examiner*—William C. Doerrler
*Attorney, Agent, or Firm*—Francois Martineau

[57] ABSTRACT

The apparatus for heating or cooling a house includes two housings, both of which are located inside the house. The two housings are interconnected by two exterior sections of a single heat transfer line liquid. One housing encloses an air blower to circulate and distribute the indoor air throughout the house, a radiator and a heater connected to the liquid line. The other housing encloses a refrigeration system and a water bath cooled by this system and into which is immersed a cooling coil section of the liquid line. This line interconnects the radiator with a liquid circulating pump and by electro-valves with either the cooling coil or the heater. Cold or hot heat transfer liquid circulate through the radiator which cools or heats the indoor air circulated through the second housing.

3 Claims, 1 Drawing Sheet

COMBINED AIR HEATING AND COOLING DOMESTIC UNIT

FIELD OF THE INVENTION

This invention relates generally to air cooling and heating systems, and in particular to a modified hot air furnace having a radiator supplied alternately with hot or cold liquid to heat or cool air circulated through the furnace and blown into the house through the air distribution network of the furnace.

BACKGROUND OF THE INVENTION

Canadian patent No 359,235 issued in 1936 to Milton KALISCHER discloses an air conditioning apparatus including a blower unit with separate heating and cooling coils for heating or cooling air drawn through the unit. More particularly, the apparatus comprises a first set of heating tubes and a second set of cooling tubes, and a common set of fins providing extended heating surfaces for the heating tubes, when heating fluid is circulated therethrough, and extended cooling surfaces for the cooling tubes, when cooling fluid is circulated therethrough. Such an apparatus is very inefficient in the use of available space.

U.S. Pat. No. 4,134,448 issued 16 Jan. 1979 to the corporation Raytheon Co. shows a single heat exchanger for air, with valve means to selectively provide hot or cold fluid to the heat exchanger to heat or cool the air. The furnace and the water heater are linked by water pipe lines 28, 30, including a water pump 40, so that the air conditioning system be driven by the furnace or the water heater depending on the outdoor climatic load sustained, whereby more efficient operations of the furnace and of the water heater are achieved. The compressor and condensor unit 18 is located exteriorly of the dwelling.

Canadian patent No 1,189,703 issued 2 Jul. 1985 to the Hussmann corp. also discloses an apparatus which can both heat and cool recirculated room air in an alternate fashion. Again, the condensor 44 is located exteriorly of the dwelling to be heated or cooled. Moreover, this system is mainly directed to be beneficial in commercial and industrial installations, such as food markets, convenience stores, restaurants, warehouses and manufacturing or processing facilities having primary refrigeration systems to 0provide multiple refrigeration needs.

Canadian patent No 1,129,198 issued 10 Aug. 1982 to Intertherm inc. discloses a compact electric furnace combined with an air conditioning system. An externally located module must still be envisioned.

U.S. Pat. No. 3,308,805 issued in 1967 to Hans Stöckli discloses a combined heating and air conditioning apparatus. Again, a refrigerant gaz, namely, FREON (a trademark) is supplied to the evaporators through a pipe from an externally located condensor; the evaporated refrigerant is returned to the compressor of the refrigerating plant through another pipe.

U.S. Pat. No. 4,125,151 issued Nov. 14, 1978 to the Raytheon Company discloses a compact heating and cooling system, where all the system except the air ducts are located outside of the dwelling to be heated\cooled.

U.S. Pat. No. 4,825,847 issued 2 May 1989 to the present applicant discloses a furnace unit including a water tank. A heating element is immersed in the water tank to heat the water, whereby a pump recirculates the water from the tank to a radiator. A water vapor by-pass tube interconnects the water tank to the air outlet duct, so as to humidify the air warmed by the radiator. No add-on air conditioning device is envisioned. Known air cooling systems where the compressor and air cooled condenser are located outside the house, require a thermostat to shut off the compressor operation when the outside temperature drops below about 50° F. to prevent compressor damage due to cold weather. Thus the air cooling system cannot be used in winter in cold climate regions.

OBJECTS OF THE INVENTION

An important object of the invention is to reduce the maintenance costs of combined heating and cooling apparatuses for buildings.

An object of the invention is to address heating and cooling needs particularly for domestic housing (i.e. neither industrial nor commercial) uses in the most cost-effective manner.

Another important object of the invention is to reduce outdoor noise levels from the use of combined heating and cooling apparatuses for dwellings, by having all elements thereof being located interiorly of the dwelling, so as to improve neighbourly relations.

An object of the invention is to improve upon the above-captioned U.S. Pat. No. 4,825,847 by adding an indoor air-conditioning compressor\condensor unit thereto.

Another object of the invention is to provide uniformly distributed indoor air cooling whenever required, even when the outdoor temperature is below freezing.

SUMMARY OF THE INVENTION

In accordance with the objects of the invention, there is disclosed an apparatus for heating or cooling a house. The apparatus includes two housings, both of which are located inside the house. The first housing contains a liquid bath and a refrigeration system which includes a compressor, a condenser, an evaporator coil immersed within said liquid bath and a fan for circulating condenser cooling air. Warm air discharge duct means communicate with said first housing and with the exterior of the house discharging the warm condenser cooling air to the outside of the house. The second housing has a lower return indoor air inlet and an upper indoor air discharge outlet. In this second housing are located an indoor air circulating blower and a radiator; the blower circulates the indoor air from said inlet to said outlet to be discharged into the house through an air distribution duct means communicating with said outlet, said radiator being in the path of said indoor air circulating within said second housing. The apparatus further includes a heat transfer liquid cooling coil located in said liquid bath in said first housing, a heater for said heat transfer liquid, preferably located in said second housing and a transfer liquid circulating pump. A heat transfer liquid closed loop line interconnects the cooling coil, the pump, the radiator and the heater and valve means in said line are operated to selectively connect the pump and the radiator to said heater on the one hand or to said cooling coil on the other hand for selectively circulating cold or hot heat transfer liquid through said radiator. Said line further includes legs extending between and exterior to said first and second housings to connect the cooling coil to the radiator and to the pump. Preferably, a motor operated stirrer is immersed in the water bath.

BRIEF DESCRIPTION OF THE DRAWING

The single drawing discloses a broken, partly sectional, elevational view of the combined air heating and cooling unit of the invention.

DETAILED DESCRIPTION OF THE DRAWINGS

Figure 1:
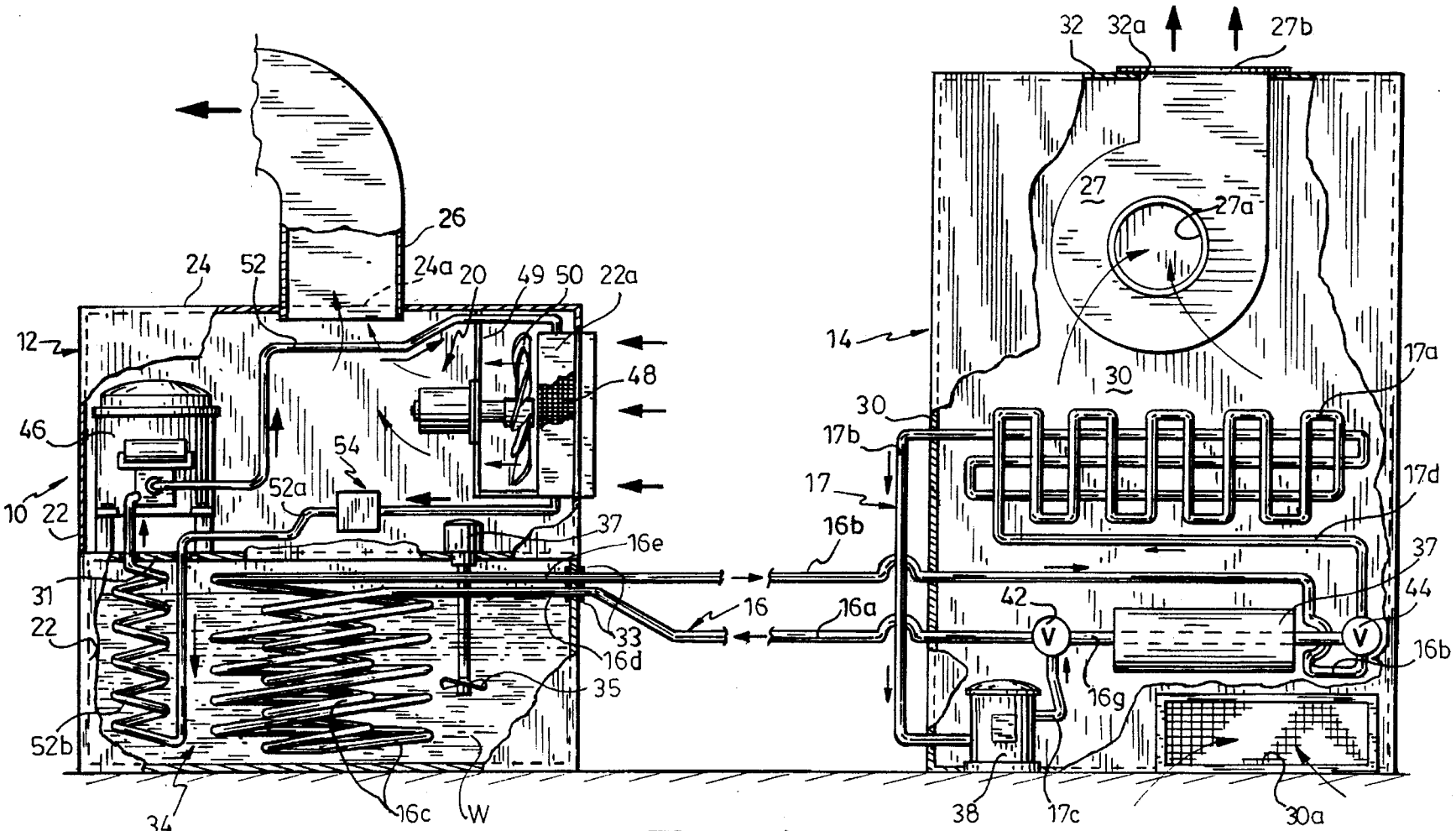

The combined air heating and cooling apparatus of the invention, illustrated as 10 in the single FIGURE, includes two main ground-standing housings 12, 14. The two exterior legs 16*a*, 16*b*, of a single closed-loop heat transfer liquid line 16 (detailed below) interconnect the two housings 12 and 14. Both housings 12 and 14, as well as the exterior legs 16*a*, 16*b* of liquid line 16, are located inside and remain within the walls of a room inside a domestic housing unit (a house), to be warmed or cooled accordingly with exterior climatic conditions.

Housing 12 is bounded by a flooring 18, side walls 22 and a top wall 24; an outlet air duct 26 opens into housing 12 through an air outlet port 24*a* made in top wall 24, while an air intake port 22*a* opens into enclosure 20 through an upper portion of one side wall 22. A horizontal partition wall 31 divides the enclosure 20 into an upper chamber 20 and a lower chamber 34. Housing 12 encloses a refrigerating system which includes a compressor 46 fixedly supported by partition wall 31, a condensor 48 carried by side wall 22, within air inlet part 22*a*, an electrically powered fan 50 mounted in closely spaced register with condensor 48, via a mounting stay 49 anchored to wall 22 and condenser 48. The refrigerating system further includes an expansion valve 64, an evaporator coil 52*b* and coolant fluid line 52 and 52*a* connecting the compressor output to the condenser inlet and the condenser outlet to the expansion valve 54 and evaporator coil 52*b* respectively. The latter is in turn connected to the compressor inlet compressor 46, condenser 48, fan 50 and expansion valve 54 are located within upper chamber 20 while evaporator coil 52*b* is located within lower chamber 34 which contains water W to form a water bath. An impeller 35, powered by an electric motor 37, is anchored to partition wall 31 and depends downwardly therefrom, extending into water chamber 34 to stir water W.

Compressor 46 and condensor 48 cooperate in the conventional fashion for a refrigerating unit. Namely, compressor 46 compresses the coolant gas which is condensed in condensor 48. Expansion valve 54 causes a pressure drop of the condensate and its evaporation within coil 52*b* with concurrent decrease in temperature of coolant fluid. Condenser 48 is cooled by indoor air withdrawn by fan 50 and discharged from the upper chamber 20 to the exterior of the house through outlet air duct this duct opening on the outside of the house in which housing 12 is located. Water W in lower chamber 34 is chilled by evaporator coil 52*b* which is immersed in water W.

The main liquid line 16 forms a vertically extending double-coil segment 16*c* immersed in water W of lower water chamber 34 and connected to exterior legs 16*a* and 16*b* via top horizontal line segments 16*b* and 16*e* respectively Line segments 16*d*, 16*e*, extend through side wall 22 in a water-tight fashion, thanks to water-tight sleeves 33 being embedded in corresponding bores made in side wall 22.

Hence, upon energizing refrigeration elements 46 and 48, evaporator coil 52*b* will cool water W which in turn will decrease the temperature of the heat transfer liquid in double-coil 16*c* of line 16.

Housing 14 is bounded by four side walls 30 and a top wall 32; an air aperture 32*a* is made in top wall 32, and an air return opening 30*a* is made at the lower portion of one wall 30. Inside housing 14, there is provided an electric motor operated air blower 27 such as used in a conventional hot air furnace. The casing of blower 27 includes a lower air intake port 27*a*, opening into housing 14, and an upper air outlet flanged mouth 27*b* inserted within aperture 32*a* and secured to top wall 32. Mouth 27*b* is connected to a standard air distribution duct network (not shown) to distribute hot or cool air throughout the house.

Inside housing 14, there is provided an electric pump 38, to circulate the heat transfer liquid through line 16, through a radiator 17*a* and through an electric liquid heater 37. Radiator 17*a* is located in housing 14 between air intake port 27*a* of air blower 27 and air return opening 30*a* and serves to cool or heat the air circulated through housing 13. In the cooling mode, radiator 17*a* is connected to pump 38 and cooling coil 16*c* in the following manner: cooling coil 16*c*, exterior leg 16*b*, three-way electro-valve 44, line segment 17*d*, radiator 17*a*, line segment 17*b*, pump 38, line segment 17*c*, electro-valve 42, exterior leg 16*a* and cooling coil 16*c*. In the heating mode, radiator 17*a* is connected to pump 38, and heater 37 in the following manner: heater 37, valve 44, line segment 17*d* radiator 17*a*, line segment 17*b*, pump 38, line segment 17*c*, valve 42 and line segment 16*g* back to heater 37. Line segments 17*b*, 17*c* and 17*d* are collectively denoted as line 17 which forms a continuation of line 16.

The operation of the heating\cooling apparatus can now be understood. As previously mentioned, two alternate modes exist: a heating mode, and a cooling (or air conditioning) mode. Each mode operates independently of the other and in alternating fashion relative to each other.

In the heating mode of the apparatus 10, liquid heater 39 is energized; three-way electrovalve 42 closes line 16*a* so as to operatively interconnect lines 17*c* and 16*g;* and three-way electrovalve 44 closes line 16*b* so as to operatively interconnect lines 17*d* and 16*g*. Hence, radiator 17*a* is heated by heater 37. Indoor, cooler air comes from the furnace room through air return opening 34*a*, is heated by radiator 17*a*, enters the air intake port 27*a* and blower 27 expels the warm air upwardly through outlet port 27*b*, toward conventional warm air distribution channel ducts (not shown). In this heating mode of the apparatus 10, liquid circulation pump 38 is operating. However, condenser 46, compressor 48, fan 50 and impeller 35 are all inoperative.

In the cooling mode of the apparatus 10, refrigerant means 46 and 48 are energized; electrovalve 42 closes line 16*g* so as to operatively interconnect lines 17*c* and 16*a;* and electrovalve 44 closes line 16*g* so as to operatively interconnect lines 16*b* and 17*d*. Liquid circulation pump 38 is activated, whereby the heat transfer liquid flows freely through lines 16 and 17 (except through the heater line segment 16*g*).

Fan 50 is also energized, together with impeller 35. Preferably, the liquid flowing in lines 16 and 17 is a mixture of water and of a freezing point lowering liquid—preferably PRESTONE (a trademark). It is noted that only the return air in the furnace room is used to cool condenser 48 thus avoiding the bleeding of the cooler air discharged into the house rooms by the air distribution ducts. The cooling system does not cause outdoor noise, a source of neighbourly friction and requires reduced maintenance since it is protected by the house itself against atmospheric conditions. In cold climate regions, the indoor cooling system can be operated even in cold weather to obtain uniformly distributed cooled indoor air thus avoiding a cold draft entering through an open window. The use of a water bath with a heat transfer liquid circuit including exterior legs 16*a*, 16*b* confers flexibility in the relative locations of the two housings 12 and 14 in accordance with the shape of the available house space for receiving these housings or cabinets.

I claim:

1. A combination heating and cooling domestic apparatus for use inside a house comprising:

(a) first and second separate housings to be wholly located inside said house;

(b) a refrigeration system and a liquid bath enclosed in said first housing, said system including a compressor, a condenser, an evaporator coil within said liquid bath and a fan for circulating condenser cooling air, said first housing having an indoor air inlet for admission of said condenser cooling air;

(c) warm air discharge duct means communicating with said housing and with the exterior of said house for discharging to the outside air the heated condenser cooling air;

(d) said second housing having a lower indoor air inlet and an upper indoor air discharge outlet;

(e) an indoor air circulating blower and a radiator enclosed in said second housing, said blower circulating said indoor air from said inlet to said outlet to be discharged into said house through an air distribution duct means communicating with said outlet, said radiator in the path of the indoor air circulating within said second housing;

(f) a heat transfer liquid cooling coil located in said liquid bath in said first housing;

(g) a heater for said heat transfer liquid;

(h) a power operated heat transfer liquid circulating pump;

(i) a heat transfer liquid closed loop line interconnecting said cooling coil, said pump, said radiator and said heater; and (j) electro-valve means in said line for connecting said pump and said radiator to said heater or to said cooling coil for selectively circulating cold or hot heat transfer liquid through said radiator; said line including legs extending between and exterior to said first and second housings.

2. A combination cooling and heating domestic apparatus as defined in claim 1, wherein said heater in an electric heater located within said second housing.

3. A combination heating and cooling domestic apparatus as defined in claim 1, wherein said first housing has an intermediate horizontal partition defining an upper chamber and a lower chamber within said first housing, said upper chamber containing said refrigeration system except said cooling coil, said lower chamber forming said liquid bath.

* * * * *